US005619857A

United States Patent [19]

Caldwell et al.

[11] Patent Number: 5,619,857

[45] Date of Patent: Apr. 15, 1997

[54] DEWAR FOR STORING AND DELIVERING LIQUID CRYOGEN

[75] Inventors: Bruce D. Caldwell, Hitchcock; Paul D. Duncan, League City; John H. Fricker, Seabrook; Rick C. Hunter, Friendswood, all of Tex.

[73] Assignee: Oceaneering International, Inc.

[21] Appl. No.: 512,363

[22] Filed: Aug. 8, 1995

Related U.S. Application Data

[63] Continuation-in-part of Ser. No. 957,599, Oct. 6, 1992, Pat. No. 5,438,837.

[51] Int. Cl.[6] ..... F17C 13/00; F25D 23/12

[52] U.S. Cl. ..... 62/50.1; 62/50.7; 62/259.3; 62/49.2

[58] Field of Search ..... 62/49.1, 49.2, 62/50.1, 50.7, 259.3, 45.1, 50.2, 51.1, 54.1

[56] References Cited

U.S. PATENT DOCUMENTS 3,869,871 3/1975 Rybalko et al. ..... 62/178
5,438,837 8/1995 Caldwell et al. ..... 62/50.1

*Primary Examiner*—William Doerrler
*Attorney, Agent, or Firm*—Vaden, Eickenroht & Thompson, L.L.P.

[57] ABSTRACT

Disclosed is an apparatus for storing and delivering a liquid cryogen. The apparatus is a dewar having a rotating liquid cryogen intake, a rotating gas supply/vent, and a rotating capacitance gauge. The rotating capacitance gauge comprises two elongated plates having outer edges shaped concentrically with the inner profile of the dewar on both ends that are electrically isolated from but fastened to one another with a small gap therebetween and electrical leads to the exterior of the dewar.

15 Claims, 8 Drawing Sheets

DEWAR FOR STORING AND DELIVERING LIQUID CRYOGEN

BACKGROUND OF THE INVENTION

This application is a continuation-in-part of application Ser. No. 07/957,599 filed Oct. 6, 1992, now U.S. Pat. No. 5,438,837, the earlier effective filing date of which is hereby claimed.

FIELD OF THE INVENTION

This invention pertains to the application of cryogenic technology to life support systems and, more particularly, to a dewar for storing and delivering a cryogenic fluid.

DESCRIPTION OF THE PRIOR ART

"Cryogenic" is a term used to describe physical conditions at temperatures less than approximately 123K. (−151° C., −239° F.). A "cryogenic fluid" may be defined as a fluid whose temperature is less than approximately 123K. (−151° C., −239° F.) that boils at temperatures less than approximately 110K. (−262° F., −163° C.) at atmospheric pressure and a cryogenic fluid may therefore be either a gas or a liquid. Although these definitions are adequate for many applications, the terms are capable of many definitions and the use of the terms herein should be construed consistently with the many definitions accepted by those in the art. Examples of cryogenic fluids include both nitrogen and oxygen, the primary components of "liquid air". The term "cryogen" as used herein shall refer to a cryogenic fluid and the term "cryogenic technology" shall refer to knowledge, techniques, and equipment for harnessing physical properties of cryogenic fluids to practical applications.

A wide variety of diverse fields employ cryogenic technology and portable life support systems are experiencing a resurgent interest in cryogenic technology. Many portable life support systems store liquid cryogen in a vacuum insulated pressure vessel called a dewar from which liquid cryogen is delivered to other parts of the life support system. One such system is disclosed and claimed in U.S. Pat. No. 5,361,591 issued Nov. 8, 1994 to Oceaneering International, Inc. as assignee of the inventor Bruce D. Caldwell. An inner pressure vessel is typically jacketed by an insulative housing, the space between the pressure vessel and the insulative housing being evacuated and sometimes filled with multilayered insulation or reflective powders.

Any dewar in a portable life support system employing cryogenic fluids will contain gas and, if filled, liquid cryogen. With the exception of portable life support systems used in micro-gravity or zero-gravity environments, most portable life support system dewars rely on gravity to separate liquid cryogen from gaseous cryogen. Gravity separation is advantageous because the cryogenic fluid can be pressurized to provide a motive force in delivering the liquid cryogen from the dewar. One may therefore take advantage of the natural properties of the cryogen to deliver the liquid from the dewar by pressurizing the separated gas into the dewar's pressure vessel.

Some current efforts at portable life support system design such as that disclosed in the '591 Caldwell patent focus on using liquid cryogen as part of a cooling loop regulating the user's body temperature. Heat exchange in such a cooling loop cools the user through an intermediate cooling loop while warming the liquid cryogen, generally converting the liquid cryogen to gas. If the liquid cryogen is "liquid air", the gaseous cryogen provide a breathing air supply for the system's user.

This type of portable life support system requires a constant, uninterrupted flow of liquid cryogen from the dewar and the ability to gauge the dewar's cryogen content. Additionally, liquid withdrawal is necessary to (1) control the pressure of the dewar contents, (2) utilize the phase change from liquid to gas provides one-half the cooling capacity of the system, and (3) deliver a consistent component mixture for the air in the breathing air supply. Thus, gravity separation can be very advantageous.

The drawback to gravity separation is that liquid cryogen's position shifts within the dewar when the orientation of the dewar is changed with respect to gravity. The dewar for a portable life support system is usually worn on the back of the system user and, whenever the user bends at the waist, the orientation of the dewar with respect to gravity changes. Such changes in orientation can also occur by body movements other than those at the waist. These changes can occur in one, or both, planes of movement: (1) forward and back, and (2) side to side.

The shift in position by the dewar's liquid contents can expose a typically fixed intake port in a standard upright dewar through which liquid cryogen is delivered from the dewar. When the port is exposed, the pressurized gaseous cryogen escapes through the port. This depressurizes the dewar, eliminates the motive force for and interrupts the delivery of liquid cryogen. For instance, if someone wearing a portable life support system stoops or bends over as if to lift something, the port may become exposed and allow the pressurized gas to escape and interrupt the liquid cryogen's delivery until the port is once again immersed in the liquid cryogen and pressure is restored to the dewar.

The position shift of the dewar's contents also causes problems in ascertaining the volume of liquid cryogen remaining in a standard upright dewar. It is also desirable to fully utilize the contents of the dewar. This requires an accurate determination of liquid cryogen levels in the dewar at virtually all times. Current techniques employ a capacitance gauge fixed in a gravity vector in the dewar which distinguishes gas from liquid by their differing dielectrics. The capacitance of the gauge varies with the level of liquid, and so the shifting of liquid cryogen within the dewar caused by user movement also prohibits accurate determination of liquid cryogen levels in the dewar.

It is therefore an object of this invention to provide a dewar for the delivery of a liquid cryogenic fluid without interruption resulting from changes in orientation with regard to gravity.

It is a further object of this invention to provide an apparatus for accurately determining the amount of liquid cryogen within a dewar, especially during changes in orientation relative to gravity.

SUMMARY OF THE INVENTION

This and other objects are accomplished in accordance with one or more embodiments of this invention, by a dewar comprising an insulated pressure vessel; first means through which liquid cryogen may be supplied to and delivered from the pressure vessel; and second means through which a gas may be supplied to the pressure vessel and vented from the pressure vessel; the first means including an intake means having an open end and extending into the pressure vessel. More particularly, an internal portion of the first means is mounted for rotating in the vessel about a first axis, and the inner wall of the pressure vessel concentric to the first axis being so formed and the internal portion being of such length that the open end of the intake means passes closely to the interior wall as the pressure vessel is caused to incline with respect to a plane passing through the first axis.

The dewar also includes a capacitance gauge for measuring the liquid content within the vessel, comprising: a first plate having outer edges shaped concentrically with the inner profile of the vessel; a second plate having outer edges concentrically shaped with the inner profile of the vessel and electrically isolated from but fastened to the first plate with a small gap therebetween; and electrical leads from the first and second plates to the exterior of the vessel.

BRIEF DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only preferred embodiments of the invention and are not to be considered limiting of its scope as the invention will admit to other equally effective embodiments. In the drawings.

DESCRIPTION OF THE PREFERRED EMBODIMENTS

Figure 1:
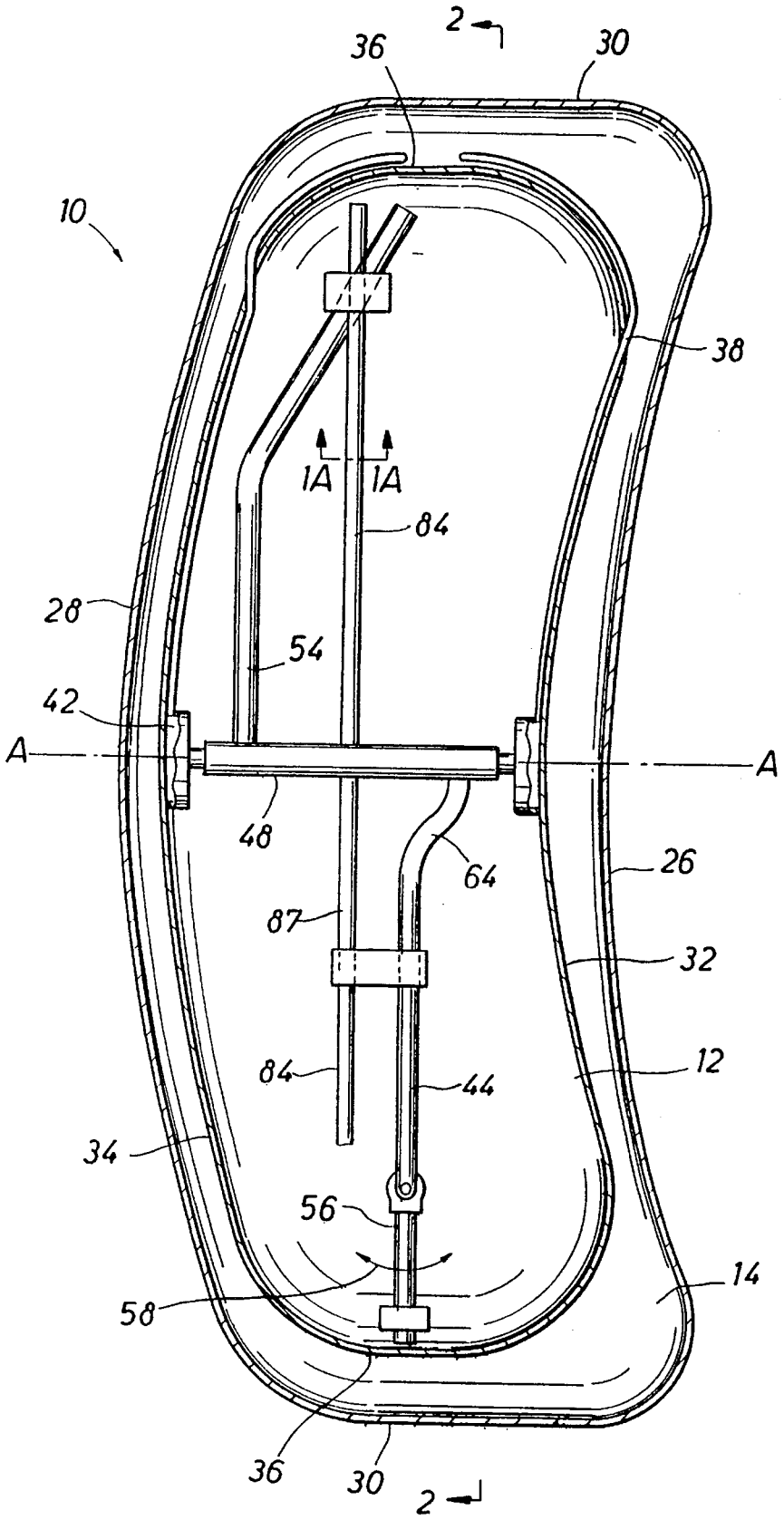
FIG. 1 is a longitudinal, sectional view of the dewar in a first embodiment along line 1—1 of FIG. 2.

The dewar, in a first embodiment illustrated in FIGS. 1–5 and generally denoted 10, is comprised of pressure vessel 12 mounted within insulative housing 14 as best shown in FIG. 1. Dewar 10 in the preferred embodiment is intended for use in a portable life support system such as that in the '591 Caldwell patent discussed above as a "self-pressurizing dewar", i.e., gas produced by the system in the cooling loop is used to pressurize the contents of pressure vessel 12. However, other external means of pressurization may be used as may be apparent to those in the art. For instance, several acceptable alternatives are disclosed in the '591 Caldwell patent.

Figure 3:
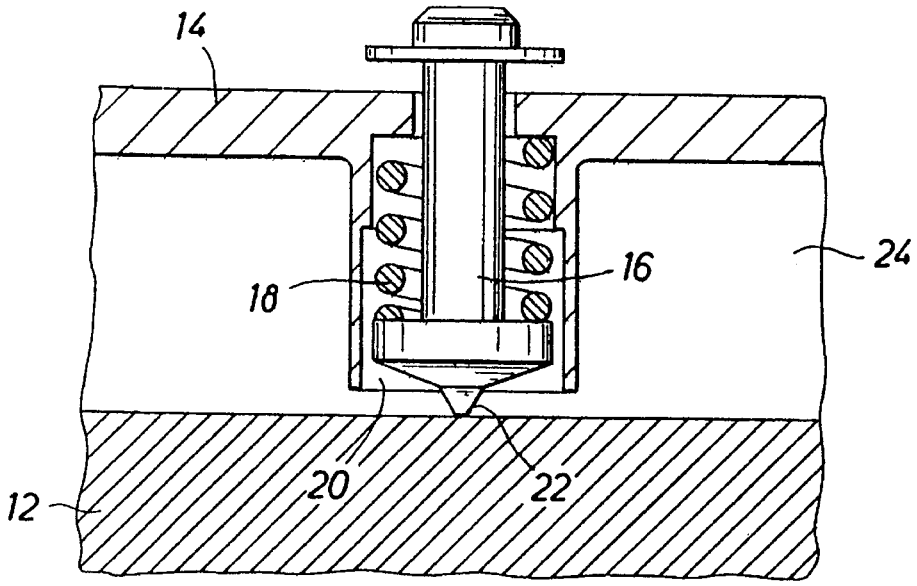
FIG. 3 is an enlarged illustration of part of a system suspending the insulated pressure vessel within the insulative housing of the first preferred embodiment of the dewar.

Pressure vessel 12 is mounted within insulative housing 14 in a manner minimizing heat transfer from insulative housing 14 to pressure vessel 12. In the preferred embodiment of FIGS. 1–5, pressure vessel 12 is mounted using a suspension system comprising a plurality of "point contacts" such as that shown in FIG. 3. Each suspension point of the point contact suspension system is as illustrated in FIG. 3, and generally comprises reciprocable suspension member 16 biased inwardly by return spring 18 within recess 20. The reciprocal movement of suspension member 16 compensates for changes in dimension of pressure vessel 12 and insulative housing 14 caused by fluctuations in temperature and pressure. Contact 22 of suspension member 16 is essentially a point to minimize surface contact and therefore heat transfer from insulative housing 14 to pressure vessel 12.

The point contact suspension system of the preferred embodiment of FIGS. 1–5 is not the only method by which pressure vessel 12 may be mounted within insulative housing 14. Many methods of suspension are known and used in the construction of dewars. Examples include straps and webbing, and any of these alternatives may be acceptable. An alternative suspension system is discussed below in connection with the preferred embodiment of FIGS. 6–9. Insulative housing 14 is not required in all embodiments of the invention, and the method of suspending pressure vessel 12 therein is not a consideration in such embodiments. For instance, the Earth's moon is a gravity rich environment but has no atmosphere such that pressure vessel 12 as further described herein would be vacuum insulated without insulative housing 14.

Still referring to FIG. 3, additional insulation for dewar 10 can be obtained by properly using space 24 between pressure vessel 12 and insulative housing 14. A vacuum is drawn in space 24 between pressure vessel 12 and insulative housing 14 and space 24 may be filled with multi-layer insulation or reflective powders as is known in the industry. Other methods such as filling space 24 with insulative foams such as polyurethane or Aerogel may be equally acceptable. The inner and outer walls of pressure vessel 12 and/or insulative housing 14 may furthermore be metal-plated to reflect heat and thereby minimize radiative heat transfer between pressure vessel 12 and insulative housing 14.

Figure 2A:
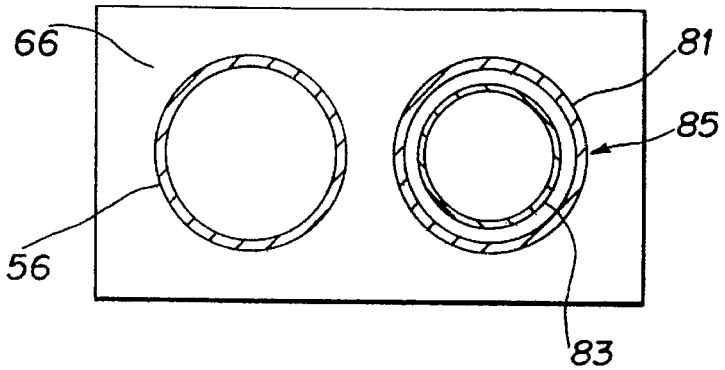
FIG. 2A is a cross-sectional view of the liquid cryogen pickup and the capacitance gauge along line 2A—2A of FIG. 2.
Figure 2:
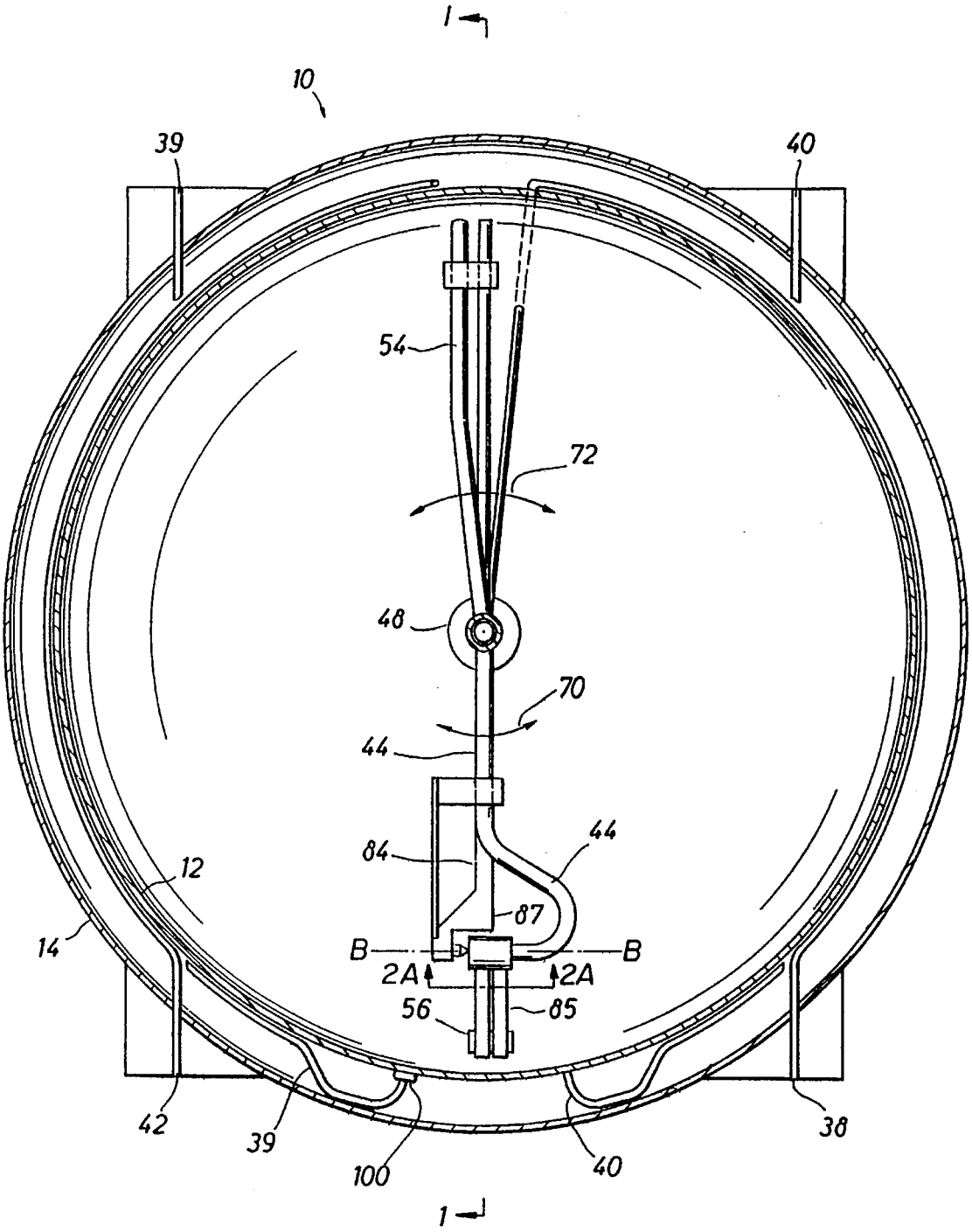
FIG. 2 is a cross-sectional view of the dewar taken along line 2—2 of FIG. 1.

FIGS. 1 and 2 best illustrate the profiles of pressure vessel 12 and insulative housing 14 and, hence, dewar 10 as a whole. Insulative housing 14 is comprised of first wall 26 and second wall 28, both of which are preferably substantially circular in shape, joined at their outer edges to form side wall 30. Pressure vessel 12 is likewise comprised of first wall 32 and second wall 34, each of which are also preferably substantially circular in shape, joined at their outer edges to form side wall 36. Side wall 36 is preferably cylindrical since, as will be described, this greatly facilitates the delivery of liquid cryogen by the rotating intake.

Dewar 10 in the preferred embodiment is intended to be mounted on the back of a portable life support system user. First wall 26 and third wall 32 are therefore convex-shaped to fit snugly against the back of the user and second wall 28 and fourth wall 34 are concave-shaped, concave and convex being defined relative to the volumetric center of pressure vessel 12. To this extent, the use for which dewar 10 is intended also affects the profile of pressure vessel 12 and insulative housing 14 and any combination of convex and concave shape may be suitable or even desirable depending upon the particular application to which dewar 10 might be put.

The liquid cryogen supply and delivery means of dewar 10 comprises enclosed channel 38 and fill lines 39–40. Each of fill lines 39–40 begins external to insulative housing 14, passes through the wall thereof into space 24, and is sealably joined to apertures in the wall of pressure vessel 12 as best shown in FIG. 2. Enclosed channel 38, as shown in FIG. 2, begins external to insulative housing 14, passes through the wall thereof into space 24, through space 24 and through the wall of pressure vessel 12 as shown in FIG. 1 to central hub 48. The functions of fill lines 39–40 and enclosed channel 38 may be combined in some embodiments to produce a single fluid flow line. Fill line 39 terminates in expansion valve 100 specifically for use in rapid fill processes in the preferred embodiment. Fill line 40 does not include an expansion valve and can be used with conventional filling processes.

The gas supplying and venting means is generally comprised of enclosed channel 42. Enclosed channel 42, as shown in FIG. 2, begins external to insulative housing 14, passes through the wall thereof into space 24 and, as shown in FIG. 1, through the wall of pressure vessel 12 to central hub 48. The supplying and venting functions of enclosed channel 42 may be performed by separate lines but the preferred embodiment does not do so because rapid fill is not limited by gas venting and combination of function reduces the number of structural elements. In some embodiments, enclosed channel 42, as well as enclosed channel 38, may be fluid flow lines, such as fill lines 39–40, sealably joined to apertures in the wall of pressure vessel 12 so as to be fluidly connected to chamber 46 via perforations 49 as shown in FIG. 5.

Figure 4:
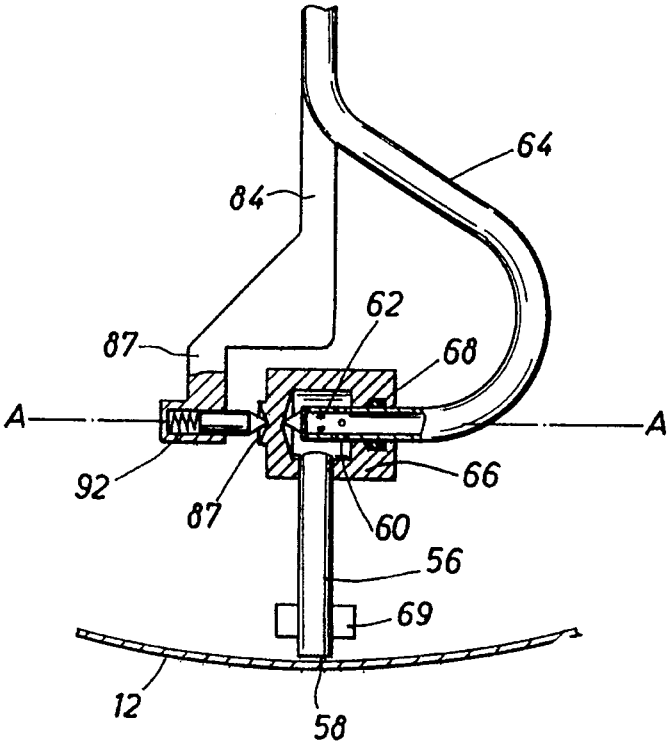
FIG. 4 is an enlargement of the liquid cryogen intake of the first preferred embodiment.
Figure 5:
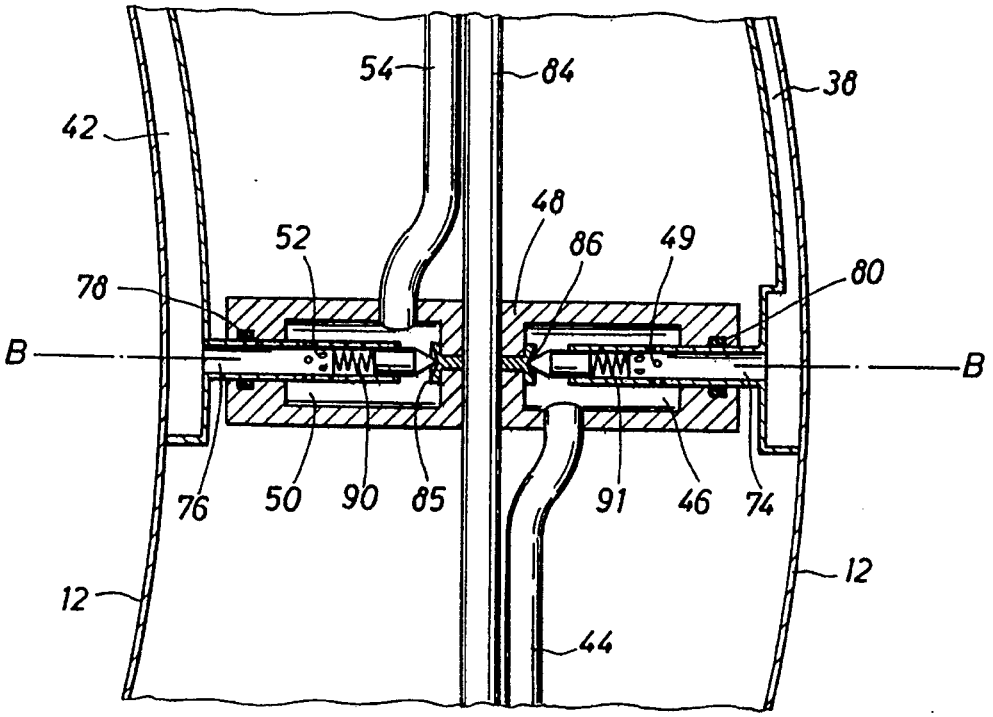
FIG. 5 is an enlargement of the rotating central hub to which the liquid cryogen intake and the gas supply/vent member of the first preferred embodiment are affixed.

Dewar 10 also includes liquid cryogen intake member 44 and ullage member 54 shown in FIGS. 1–2 and 4, both of which rotate about primary axis A—A shown in FIGS. 1 and 5 through a full 360° as illustrated by arrows 70 and 72, respectively, in FIG. 2. As best shown in FIG. 5, intake member 44 and ullage member 54 are fixedly attached to central hub 48 and sealably joined to apertures therein to fluidly connect intake member 44 and ullage member 54 with chambers 46 and 50, respectively. Central hub 48 is sealably and rotatably mounted to fingers 74 and 76 of enclosed channels 38 and 42, whose function is described below, formed in walls 32 and 34 of pressure vessel 12.

Intake member 44 is fluidly connected to the liquid cryogen supplying and delivering means as illustrated best in FIG. 5. Intake member 44 is a tubular member whose contents feed into chamber 46 of central hub 48 shown in FIG. 5. Liquid cryogen enters enclosed channel 38 from chamber 46 through a plurality of perforations 49 formed in finger 74 and is then delivered from dewar 10 via enclosed channel 38. Chamber 46 is preferably sealed at the point of rotation by seals 80 held in place by a snap ring. Intake member 44 in the preferred embodiment is sufficiently long to extend nearly the full radius of pressure vessel 12 to side wall 36 and therefore circumscribes side wall 36 as it rotates about axis A—A.

Ullage member 54 is also tubular and is fluidly connected to enclosed channel 42 of the gas supply and delivery means as best shown in FIG. 5 such that gas may be supplied to and vented from the ullage of pressure vessel 12. Gas flows through tubular ullage member 54 to chamber 50 of central hub 48, through perforations 52 to enclosed channel 42, and out enclosed channel 42 to vent gas. Chamber 50 is preferably sealed at the point of rotation seals 80 held in place by a by snap ring. The process of supplying gas via ullage member 54 is simply reversed from that of venting. Ullage member 54, like intake member 44, in the preferred embodiment is sufficiently long to extend nearly the full radius of pressure vessel 12 to side wall 36 and therefore circumscribes side wall 36 as it rotates about axis A—A.

Intake member 44 in the preferred embodiment consists of main piece 64 and end piece 56. As best shown in FIG. 4, end piece 56 is fixedly attached to hub 66, hub 66 rotating about the end of main piece 64 in which perforations 62 are formed. Chamber 60 is sealed at the point of rotation, the seal being held in place by seal 68 held in place by a snap ring to maintain integrity of the fluid flow channel from end piece 56 to main piece 64. Liquid cryogen enters end piece 56, and hence intake member 44, via intake aperture 58 in the end of end piece 56 and travels through chamber 60 and perforations 62 to enter main piece 64 of intake member 44.

End piece 56 of intake member 44 rotates about secondary axis B—B shown in FIGS. 2 and 4 in a 180° arc illustrated by arrow 59. Through rotation of end piece 56 about axis B—B, intake member 44 sweeps side wall 36 in the preferred embodiment. Thus, intake member 44, and hence intake aperture 58, both circumscribes side wall 36 through rotation about axis A—A and sweeps side wall 36 through rotation about axis B—B.

Weight 69 is fixedly mounted to end piece 56 near intake 58 to ensure that end piece 56 rotates about axis B—B in response to gravity. Weight 69 also ensures rotation of intake member 44 as a whole, and also ullage member 54 about axis A—A in response to gravity. However, the weight and length of end piece 56 or intake member 44 may be sufficient in some embodiments to eliminate the need for weight 69.

Dewar 10 in the preferred embodiment therefore incorporates two axes of rotation such that intake member 44 both sweeps and circumscribes side wall 36 as it rotates about axes A—A and B—B, respectively. The rotation of intake member 44 about both axis A—A and axis B—B in response to gravity ensures that intake 58 remains immersed in the liquid cryogen. Since ullage member 54 also rotates as does intake member 44, ullage member 54 remains in the ullage of pressure vessel 12 and out of the liquid.

However, in accordance with the broader aspects of the invention, it is not necessary to both sweep and circumscribe side wall 36, i.e., either sweeping or circumscribing may be sufficient although it is preferable to perform both functions. It is consequently not necessary that third wall 32 and fourth wall 34 be substantially circular or that side wall 36 be rounded. For instance, if the preferred embodiment in FIGS. 1–5 were modified so that intake member 44 did not rotate about axis A—A to circumscribe side wall 36, third wall 32 and fourth wall 34 could be shaped differently (even differently from each other) from what is shown in the preferred embodiment without detracting from the ability of intake member 44 to sweep side wall 36. Conversely, if intake member 44 circumscribes but does not sweep side wall 36, side wall 36 need not be rounded since the roundness of side wall 36 facilitates sweeping only. The profile of the pressure vessel 12 of dewar 10 is therefore primarily predicated on the selection and placement of the axis or axes of rotation.

Gas of some sort is also generally supplied to the ullage of pressure vessel 12 in order to pressurize the contents. Alternatively, gas pressure buildup during filling may be vented to operational levels. Either way, gravity will operate to separate the liquid from the gas because of their differing specific gravities, the heavier liquid being layered on the "bottom" of the dewar "beneath" the gas.

Because both intake member 44 and ullage member 54 are fixedly attached to central hub 48, ullage member 54 rotates as intake member 44 rotates in response to gravity. Furthermore, since ullage member 54 and intake member 44 extend from central hub 48 in opposite directions, ullage member 54 rotates in response to gravity to ensure that it remains at least partially emergent from the liquid cryogen. It is generally desirable for the gas supply/vent of ullage member 54; however, in some embodiments this factor may not be a consideration and a conventional, non-rotating gas supply/vent may be used. Because intake 58 remains immersed in the liquid cryogen, there is no interruption of liquid cryogen delivery and the contents of dewar 10 are never depressurized as a result of a change in the orientation of dewar 10 with respect to gravity.

Figure 1A:
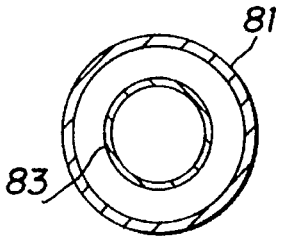
FIG. 1A is a cross-sectional view of the capacitance gauge of the dewar shown in FIG. 1 along line 1A—1A therein.

The preferred embodiment of dewar 10 also contains gauge 84 by which the liquid cryogen contents of the dewar may be measured. The relationship of gauge 84 to the other components of dewar 10 discussed thus far is best illustrated in FIGS. 1–2. Gauge 84 is a capacitance gauge, whose measured capacitance is proportional to the depth of the liquid in which it operates and which distinguishes liquid cryogen from gas cryogen by their different dielectric properties. Capacitance gauges such as gauge 84 are well known in the art and gauge 84 comprises outer shell 81 and concentric inner plate 83, which is typically tubular as shown in FIG. 1A.

Gauge 84 is affixed to ullage member 54 on one end of gauge 84 by clamp 94 and is affixed to intake member 44 by clamp 96 on the other end, and so gauge 84 rotates in response to gravity as do ullage member 54 and intake member 44 about axis of rotation A—A to ensure that the same end of gauge 84 remains immersed in the liquid cryogen. Capacitance gauge 84, analogous to intake member 44, preferably consists of main piece 87 and end piece 85. End piece 85 of gauge 84 rotates about axis B—B with end piece 56 of intake member 44 to sweep as well as circumscribe side wall 36. As shown in FIG. 2A, end piece 85 also comprises outer shell 81 and tubular, concentric, inner plate 83. The outer shell 81 of end piece 85 must be wired to outer shell 81 of main piece 87 and inner plate 83 of end piece 85 must be wired to inner plate 83 of main piece 87 to connect the gauge sections.

The capacitance measured by gauge 84 is monitored via electrical contacts 85–86 shown in FIG. 5 and electrical contact 89 shown in FIG. 4, through electrical leads (not shown) routed through intake member 44 and enclosed channel 38, and enclosed channel 42. One of outer shell 81 and inner plate 83 is wired to contact 85 and the other to contact 86 to complete the electrical circuit. One of outer shell 81 and inner plate 83 of end piece 85 of gauge 84 is wired to an electrical contact not shown and the other grounded to pressure vessel 12 in any suitable manner known to the art.

Alternatively, one of electrical contacts 85–86 can be grounded to pressure vessel 12 to eliminate one such lead. Furthermore, the electrical contact may be replaced with two simple leads, one each to the inner plate 83 and outer shell 81 of end piece 85. Springs 90–92 provide temperature compensation by maintaining the electrical contacts 85–86 and others as dimensions of the structural elements change in response to fluctuations in temperature and pressure.

An alternative dewar embodiment 10' is illustrated in FIGS. 6–9, with parts like those illustrated in FIGS. 1–2 and 4–5 bearing like numbers to dewar 10. As shown best in FIGS. 6–7, insulative housing 14' comprises first wall 26', second wall 28', and end wall 30'. Insulative housing 14', like insulative housing 14 in FIGS. 1–5 is preferably constructed of titanium or some other sturdy, suitable material as will be apparent to those in the art.

Figure 6:
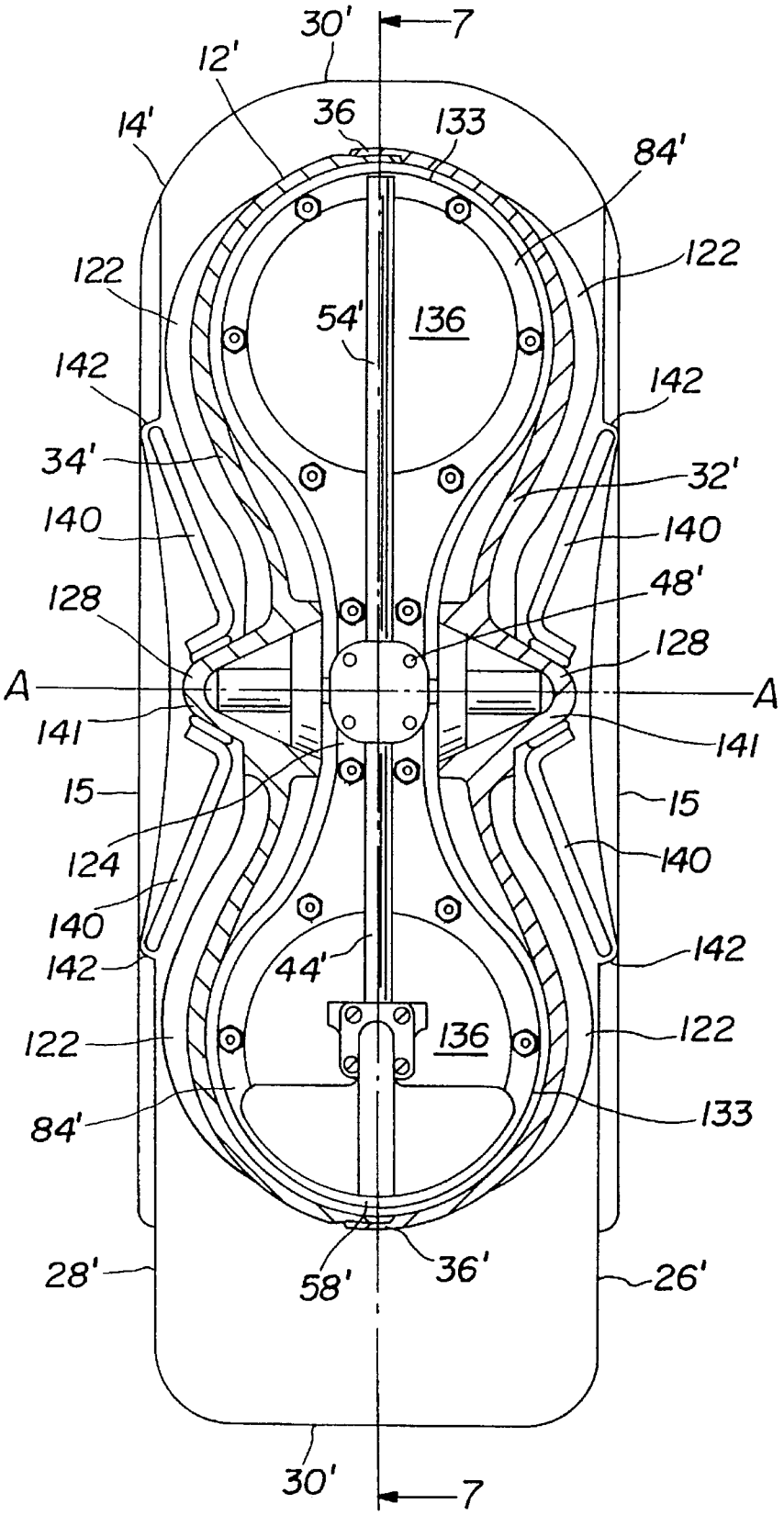
FIG. 6 is a longitudinal, sectional view of the pressure vessel of a dewar in a second preferred embodiment alternative to that of FIGS. 1–5 along line 6—6 of FIG. 7.
Figure 7:
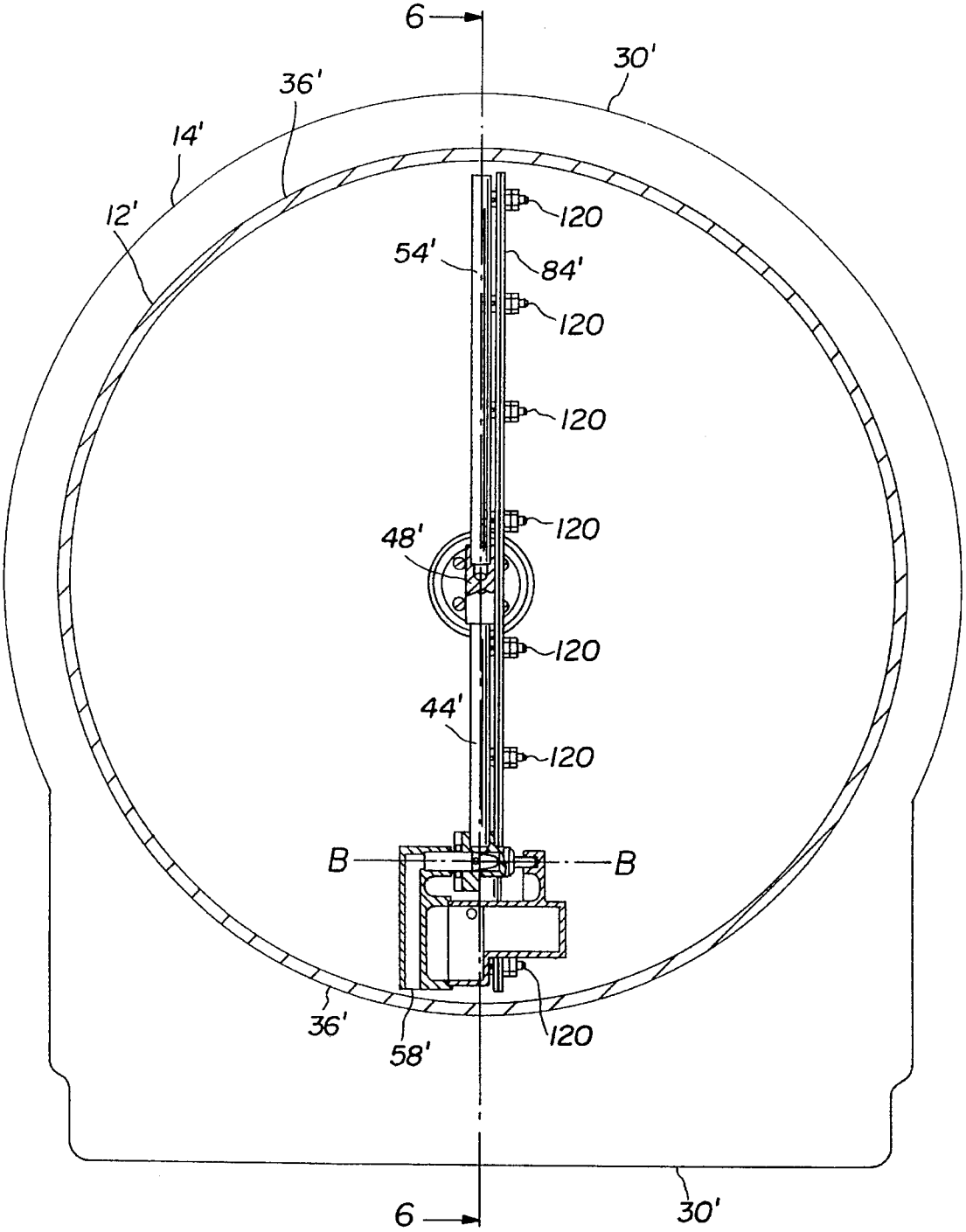
FIG. 7 is a cross-sectional view of the second preferred embodiment shown in FIG. 6 along line 7—7 in FIG. 6.

Pressure vessel 12' comprises first wall 32', second wall 34', and side 36' formed by overlapping the edges of first and second walls 32' and 34' as shown in FIG. 6. Both first wall 32' and second wall 34' are substantially convex in longitudinal section as shown in FIG. 6 and substantially circular in cross section as shown in FIG. 7. Side walls 28' and 26' of insulative housing 14' can be similarly shaped so that the profile of insulative housing 14' matches that of pressure vessel 12' or may be shaped as shown in FIGS. 6–7.

Figure 9:
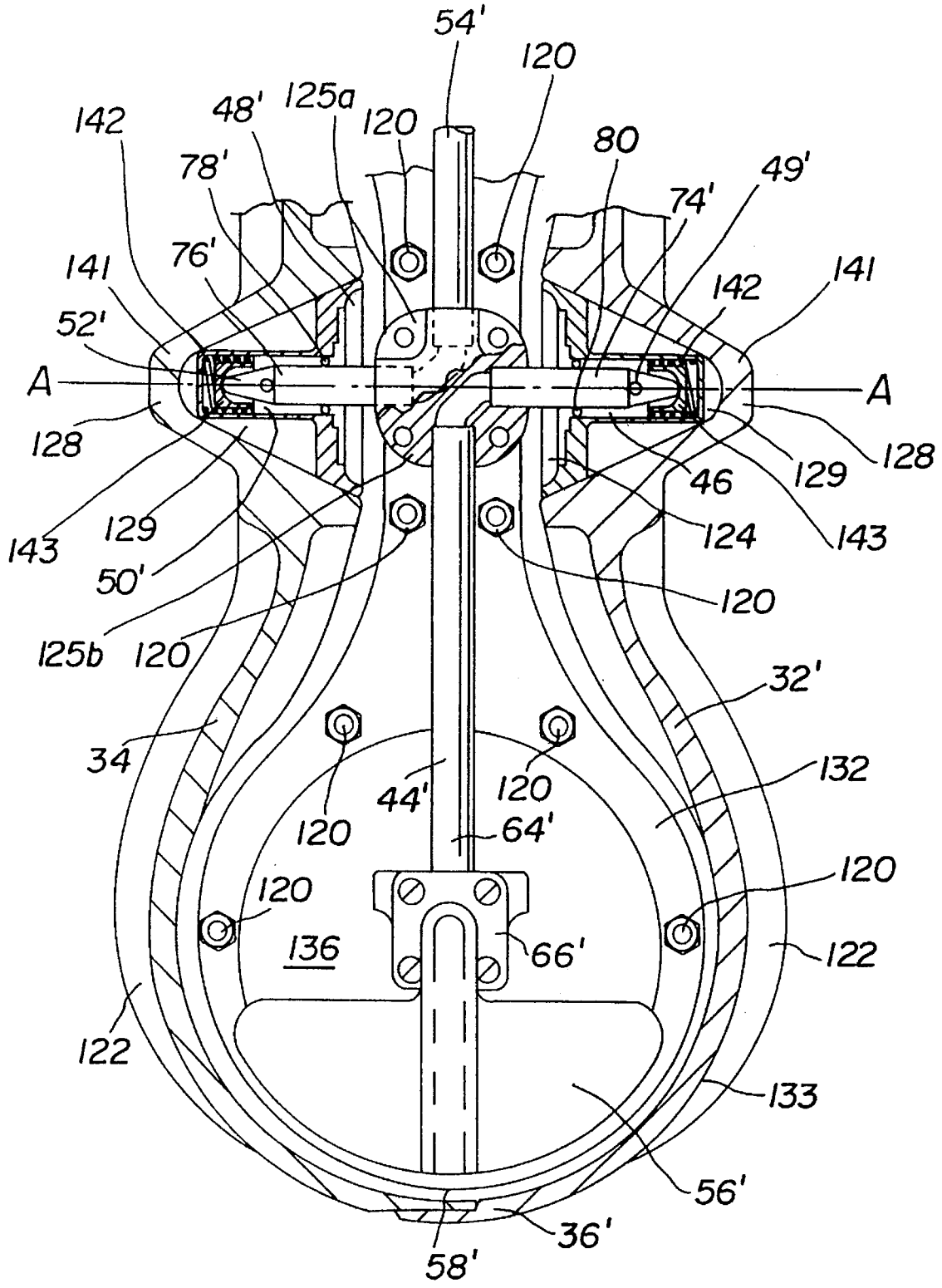
FIG. 9 illustrates the liquid cryogen pickup shown in FIGS. 6–7 enlarged from the view of FIG. 7.

Pressure vessel 12' includes a plurality of ribs 122 extending outwardly from first and second walls 32' and 34' and radially from midpoint 128 as shown best in FIG. 6 and also in FIG. 9 Pressure vessel 12' including ribs 122, may be constructed of any suitable material known to the art, preferably a thermoplastic. The materials for pressure vessel 12' and insulative housing 14' may, however, be of any suitable type known to the art, the selection turning on well known design criteria such as weight, insulative properties, low dewar profile, and high volume.

The alternative dewar embodiment of FIGS. 6–9 also mounts pressure vessel 12' within insulative housing 14' differently than does the embodiment of FIGS. 1–5. Thus, pressure vessel 12' is mounted on suspension cones 140 extending from raised pads 142 on interior wall 15 of housing 14' to bosses 141 on either side of pressure vessel 12'. Cones 140 support and thermally isolate pressure vessel 12' within insulative housing 14' and may be fabricated from any suitable, stiff, low thermal conductivity material known to those in the art.

The cone design complements the shape of pressure vessel 12' and insulative housing 14' by providing a stiff, low profile, thermally insulating path while supporting pressure vessel 12'. Cones 140 also balance the pressure and vacuum loads on pressure vessel 12' and the insulative housing to and transfer some of the structural load of pressure vessel 12' to insulative housing 14'.

Pressure vessel 12' includes liquid cryogen intake member 44' and ullage member 54' that rotate together as do member 44 and 54 in pressure vessel 12 of FIGS. 1–5. Members 44' and 54' are connected to means for supplying and delivery liquid cryogen and for supplying and venting gas such as is described above in FIGS. 1–5 although not shown in FIGS. 6–9 for the sake of clarity. The process for filling and venting liquid and gas from pressure vessel 12' are also the same as for pressure vessel 12 in FIGS. 1–5.

Figure 8:
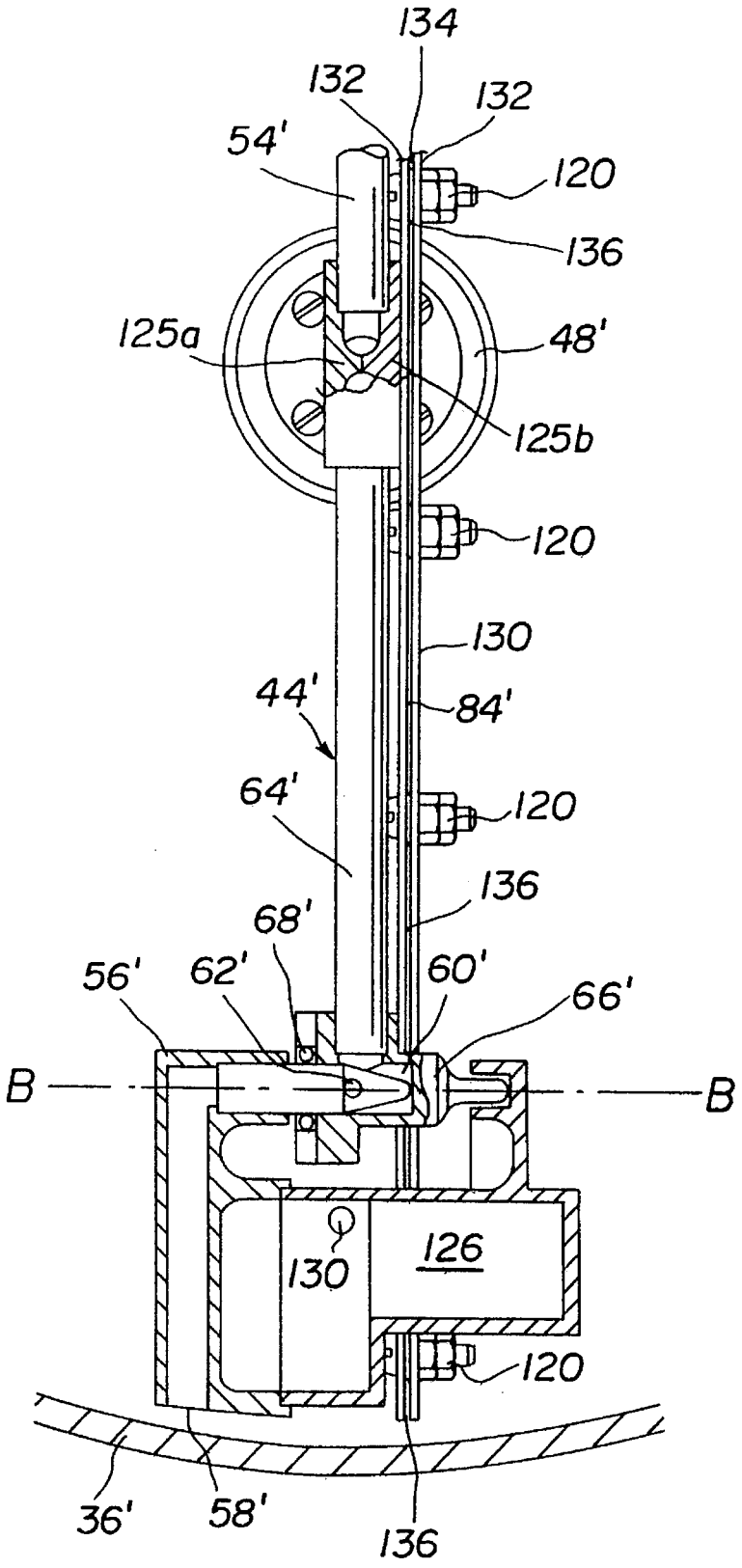
FIG. 8 is an enlarged cross sectional view of the liquid cryogen pickup of the second preferred embodiment shown in FIGS. 6–7.

Referring to FIGS. 8–9, central hub 48' comprises hub members 125*a–b* between which intake member 44' and ullage member 54', including fingers 74' and 76' thereof, are clamped and rotates about axis A—A shown in FIG. 9. Consequently, intake member 44' and ullage member 54' also rotate about axis A—A. Hub members 125*a–b* may be fastened together by threaded screws, an adhesive, a bonding agent, or some combination of these techniques. Fingers 74' and 76' are joined to intake member 44' and ullage member 54', respectively, as shown in FIG. 9 and extend into chambers 46' and 50' of seal mounts 124 in recesses 129 of bosses 141. Chambers 46' and 50' are sealed at the point of rotation to preserve the integrity of the fluid flow paths associated with intake member 44' and ullage member 54' and discussed elsewhere.

Intake member 44' is fluidly connected to a liquid cryogen supplying and delivering means such as that illustrated FIG.

5. Intake member 44' is a tubular member whose contents feed into chamber 46' of central hub 48' through perforations 49' in finger 74'. Liquid cryogen enters enclosed channel 38 shown in FIG. 5 from chamber 46' through perforation 49' and is then delivered via enclosed channel 38.

Ullage member 54' is tubular and is fluidly connected to enclosed channel 42 also shown in FIG. 5 of the gas supply and delivery means such that gas may be supplied to and vented from the ullage of pressure vessel 12. Gas flows through tubular ullage member 54' to chamber 50' of central hub 48' through perforation 52' to enclosed channel 42, and out enclosed channel 42 to vent gas. The process of supplying gas via ullage member 54' is simply reversed from that of venting.

Intake member 44' in FIGS. 6–7 is constructed analogously to intake member 44 of FIGS. 1–5 and comprises main piece 64' joined to end piece 56' as shown in FIG. 8. Main piece 64' rotates about axis A—A and end piece 56' rotates about axis B—B orthogonal to axis A—A. Like intake member 44 of the preferred embodiment in FIGS. 1–5, intake member 44' both circumscribes and sweeps end wall 36'through rotation about axes A—A and B—B ensuring intake 58' is always at the lowest point of the vessel in any orientation.

Member 44'. however differs from member 44 in FIGS. 1–5 in the design of end piece 56'. Turning to FIG. 8, end piece 56' is a hollowed body having holes 130 through which cavity 126 may be filled with liquid cryogen stored in pressure vessel 12' to increase response to changes in orientation and thereby allows the elimination of weight 69 in FIGS. 1–5. The shape of end piece 56' provides a "weather vane" effect in which end piece 56' moves as does the liquid and its construction lightens system mass and lessens thermal mass relative to that of weight 69.

Liquid cryogen enters end piece 56', and hence intake member 44', via intake aperture 58' in the end of end piece 56' and travels through chamber 60' and perforation 62' to enter main piece 64' of intake member 44'. The juncture between end piece 56' and main piece 64' is best shown in FIG. 8. Hub 66' is fixedly attached to the end of main piece 64' in which perforation 62' is formed end piece 56' rotating about the end of main piece 64'. Chambers 46', 50', and 60' are sealed to the point of rotation by seals 78', 80', and 68', respectively.

Intake member 44' and ullage member 54' in the preferred embodiment are sufficiently long to extend nearly all the way to side wall 36' and therefore circumscribe side wall 36' of pressure vessel 12' as they rotate about axis A—A. Thus, the liquid cryogen intake of pressure vessel 12' sweeps the interior thereof as end piece 56' rotates at about axis B—B$^{\pm}$90° off the radius and circumscribes end wall 36' as main piece 64' rotates about axis A—A the same as for pressure vessel 12 in FIGS. 1—5. Further, pressure vessel 12' is bilaterally symmetrical along line 7—7 in FIG. 6 except for the point at which side walls 32' and 34' meet to form end wall 36'. The design of pressure vessel 12', in conjunction with intake member 44' and ullage member 54', permits accessibility to to the lowest point within pressure vessel 12' in all orientations through the range of motion of intake 58' and, thus, access to a larger percentage of the cryogen in the dewar.

Capacitance gauge 84' differs in construction from its counterpart gauge 84 in FIGS. 1–2 and 4–5 although it also measures capacitance as a function of liquid level. As best shown in FIGS. 8–9, gauge 84' comprises two metallic plates 132 with openings 136 therein and having gap 134 therebetween. When pressure vessel 12' is filled with liquid cryogenic fluid, the fluid fills gap 134 of gauge 84' to act as the dielectric between conducting plates 132. Outer edges 133 of plates 132 are shaped concentrically with the interior profile of pressure vessel 12' as best shown in FIGS. 6 and 9.

Plates 132 are joined by fasteners 120, fasteners 120 preferably being plastic nuts, bolts, and washers, although other suitable materials may be employed. Washers 136, made of plastic or some other electrically insulative material, on bolts 120 between plates 132 maintain the gap between members 132 and prevent an electrical short across gap 134. The design of holes 136 controls the total submerged surface area of plates 132 and therefor permit control over the reading taken with gauge 84'. Holes 136 in plates 132 are not strictly necessary for the function of gauge 84' and, although preferable, may be omitted in some embodiments. However, holes 136 are sized to maintain gauge linearity for any given interior profile of pressure vessel 12' and consequently necessary to maintain such linearity for most interior profiles.

One of plates 132 is electrically connected to finger 74' while the other of plates 132 is electrically connected to finger 76'. Both of fingers 74' and 76' contact spring-mounted cups 143 electrically connected to extensions 142. Each of finger 74', finger 76', cups 143, and extensions 142 are constructed from metallic or other electrically conductive materials and form part of an electrical circuit. An insulated electrical wire (not shown) is then affixed to each of extensions 142 through the enclosed channels and outside dewar 10' as for the embodiment of FIGS. 1–5 to complete the electrical circuit.

Gauge 84' is affixed to fingers 74' and 76' and clamped by hub members **125*a–b* to central hub 48' as are ullage member 54' and intake member 44' as described above. Gauge 84' consequently rotates with members 44' and 54' about axis A—A. In some embodiments, gauge 84' may be electrically connected to fingers 74' and 76' by the same means with which it is affixed to central hub 48'** for rotation as with a metal clamp.

The shape of plates 132 is such that rotation about axis B—B is not needed to ensure measurement along end wall 36'. This is true regardless of the gravity vector because plates 132 are shaped concentrically with the interior profile of pressure vessel 12', which, in conjunction with the bilateral symmetry of pressure vessel 12', allows the wetted surface area of gauge 84' to remain the same in all orientations for a given amount of liquid cryogen. The capacitance measured by gauge 84' is therefore directly proportional to the amount of fluid in pressure vessel 12' regardless of how pressure vessel 12' is oriented relative to the gravity vector.

It is therefore evident that the invention claimed herein may be embodied in alternative and equally satisfactory embodiments without departing from the spirit or essential characteristics thereof. Those of ordinary skill in the art having the benefits of the teachings herein will quickly realize beneficial variations and modifications on the preferred embodiments disclosed herein such as that discussed in the above paragraph, all of which are intended to be within the scope of the invention. The preferred embodiments must consequently be considered illustrative and not limiting of the scope of the invention.

What Is claimed Is:

1. An apparatus for storing and delivering a liquid cryogenic fluid, comprising:

an insulated pressure vessel;

means through which liquid cryogen may be supplied to and delivered from the pressure vessel;

means through which a gas may be supplied to the pressure vessel and vented from the pressure vessel;

the liquid cryogen supply and delivery means including: intake means having an open end and extending into the pressure vessel;

first means mounting the internal portion of the liquid cryogen supply and delivery means for rotating in the vessel about a first axis; and the inner wall of the pressure vessel concentric to the first axis being so formed and the internal portion being of such length that the open end of the intake means passes closely to the interior wall as the pressure vessel is caused to incline with respect to a plane passing through the first axis.

2. The apparatus as described in claim 1, wherein the gas supply and venting means includes:

means having an open end and extending into the ullage of the pressure vessel; and second means mounting the internal portion of the ullage means for rotating in the vessel about the first axis;

the internal portion of the second mounting means extending in a direction generally opposite to that of the internal portion of the intake means and being of such length that its open end sweeps closely to the opposite side of the interior wall of the pressure vessel as the pressure vessel is caused to incline with respect to the plane.

3. The apparatus of claim 2, wherein the first means includes a cavity which may fill with liquid cryogenic fluid.

4. The apparatus of claim 2, wherein:

the intake means includes a first section which extends through an opening into the pressure vessel and is mounted on the first mounting means and a second section which has the open end and which is hingedly connected to the first section for swinging about a second axis orthogonal to the first axis; and the inner wall of the pressure vessel concentric to the second axis being so formed and the second section of the intake means being of such length that the open end passes closely to the interior wall as the pressure vessel is caused to incline with respect to a plane passing through the second axis.

5. The apparatus of claim 1, wherein:

the intake means includes a first section extending through an opening into the pressure vessel and mounted on the first mounting means and a second section having an open end and being hingedly connected to the first section for swinging about a second axis orthogonal to the first axis; and the inner wall of the pressure vessel concentric to the second axis being so formed and the second section of the intake means being of such length that its open end passes closely to the interior wall as the pressure vessel is caused to incline with respect to a plane passing through the second axis.

6. The dewar of claim 1, wherein the pressure vessel is mounted within an insulative housing.

7. The dewar of claim 1, wherein the pressure vessel comprises first and second substantially circular walls joined by a side wall.

8. The dewar of claim 7, wherein the side wall is substantially cylindrical in shape.

9. The dewar of claim 1, including a capacitance gauge for measuring liquid content mounted to the first mounting means to rotate about the first axis.

10. The dewar of claim 9, wherein the capacitance gauge comprises:

a first electrically conductive plate having outer edges shaped concentrically with the inner profile of the pressure vessel;

a second electrically conductive plate having outer edges concentrically shaped with the inner profile of the pressure vessel and electrically isolated from but fastened to the first plate with a small gap therebetween; and electrical leads from the first and second plates to the exterior of the dewar.

11. Apparatus for measuring the liquid content of a dewar, comprising:

a first electrically conductive plate having outer edges shaped concentrically with the inner profile of the vessel;

a second electrically conductive plate having outer edges concentrically shaped with the inner profile of the vessel and electrically isolated from but fastened to the first plate with a small gap therebetween; and electrical leads from the first and second plates to the exterior of the vessel.

12. The apparatus of claim 11, wherein at least one of the first and second plates is paddle-shaped.

13. The apparatus of claim 11, wherein the first and second plates are elongated and paddle-shaped at both ends thereof.

14. The apparatus of claim 11, wherein the vessel includes means for mounting the first and second plates for rotation about a central axis.

15. The apparatus of claim 11, wherein the first and second plates rotate about the central axis.

* * * * *

UNITED STATES PATENT AND TRADEMARK OFFICE

CERTIFICATE OF CORRECTION

PATENT NO. : 5,619,857

DATED : April 15, 1997

INVENTOR(S) : Bruce D. Caldwell, Paul D. Duncan, John H. Fricker, Rick C. Hunter It is certified that error appears in the above-indentified patent and that said Letters Patent is hereby corrected as shown below:

Col. 2, line 8, after "gas" insert --which--;
Col. 3, line 50, change "cross sectional" to --cross-sectional--;
Col. 6, line 1, cancel "by";
Col. 6, line 23, change "circumscribes" to --circumscribe--;
Col. 8, line 17, after "FIG. 9" insert a period;
Col. 8, line 17, after "12'" insert a comma;
Col. 8, line 38, cancel "to" and insert a comma;
Col. 8, line 46, change "delivery" to --delivering--;
Col. 8, line 67, after "illustrated" insert --in--;
Col. 9, line 22, after "36'" insert a space;
Col. 9, line 25, after "44'" change the period to a comma;
Col. 9, line 25, after "however" insert a comma;
Col. 9, line 42, after "formed" insert a comma;
Col. 9, line 59, cancel "to" (second occurrence);
Col. 10, line 16, change "therefor" to --therefore--;
Col. 10, line 16, change "permit" to --permits--.
Col. 11 and 12, cancel claims 1 through 10.
Col. 12, renumber claims 11 through 15 as 1 through 5.

Signed and Sealed this

Twenty-eighth Day of October, 1997

Bruce Lehman

*Attest:*

BRUCE LEHMAN

*Attesting Officer*

*Commissioner of Patents and Trademarks*